United States Patent [19]

Yamauchi et al.

[11] 4,391,633

[45] Jul. 5, 1983

[54] PROCESS FOR DEPHOSPHORIZATION, DESULFURIZATION AND DENITRIFICATION OF CHROMIUM-CONTAINING PIG IRON

[75] Inventors: Takashi Yamauchi; Shigeaki Maruhashi; Morihiro Hasegawa, all of Yamaguchi, Japan

[73] Assignee: Nisshin Steel Company, Ltd., Tokyo, Japan

[21] Appl. No.: 312,065

[22] Filed: Oct. 16, 1981

[30] Foreign Application Priority Data

Oct. 21, 1980 [JP] Japan ..... 55-146351

[51] Int. Cl.[3] ..... C21C 7/02

[52] U.S. Cl. ..... 75/53; 75/58; 75/257

[58] Field of Search ..... 75/53, 58, 130.5

[56] References Cited

U.S. PATENT DOCUMENTS

| | | | |
|---|---|---|---|
| 3,695,946 | 10/1972 | Demeaux | 75/53 |
| 4,217,134 | 8/1980 | Russell | 75/58 |
| 4,263,043 | 4/1981 | Haida et al. | 75/58 |
| 4,274,869 | 6/1981 | Kristiansen et al. | 75/58 |

*Primary Examiner*—P. D. Rosenberg
*Attorney, Agent, or Firm*—Ladas & Parry

[57] ABSTRACT

A process for dephosphorization, desulfurization and denitrification of chromium-containing pig iron comprising contacting the melt of said iron with a slag comprising not less than 10% and less than 40% of CaO, not less than 5% and not more than 40% of iron oxides and more than 40% and not more than 80% of $CaF_2$ in which the content of $SiO_2$ as an impurity is not more than 10% and that the ratio $\%CaO/\%SiO_2$ is not less than 3 is disclosed. According to this process, oxidation dephosphorization of chromium-containing pig iron is effectively and economically achieved. Simultaneously desulfurization and denitrification thereof are effected, too.

11 Claims, No Drawings

PROCESS FOR DEPHOSPHORIZATION, DESULFURIZATION AND DENITRIFICATION OF CHROMIUM-CONTAINING PIG IRON

TECHNICAL FIELD OF THE INVENTION

This invention relates to a process for dephosphorization, desulfurization and denitrification of chromium-containing pig iron.

BACKGROUND OF THE INVENTION

In iron and steel, phosphorus (P), sulfur (S) and nitrogen (N) are deleterious ingredients, and it is well known that in stainless steels, if the contents of these ingredients are reduced, materials having excellent properties can be obtained. But it has been considered that dephosphorization of stainless steels, more broadly chromium-containing iron alloys, is extremely difficult; In particular oxidation dephosphorization thereof has been thought to be almost impossible. Therefore, when production of low phosphorus stainless steels is intended, specially selected low phosphorus materials are used instead of carrying out dephosphorization refining. Such specially selected materials are, of course, expensive.

As for the dephosphorization of plain pig iron, rather recently use of smelting slags containing oxides and/or carbonates of alkali metals has been proposed for the purpose of dephosphorization and desulfurization, for instance, in Japanese Laying-Open Patent Publication No. 28511/78 and "Tetsu-to-Hagane," Vol. 63,S157, 1977.

Further we developed a process for dephosphorizing chromium-containing pig iron (hereinafter referred to as "Cr pig iron"), using a slag comprising 30–80% by weight of at least one of fluorine and chloride of alkaline earth metals, 0.4–30% by weight of at least one of oxide and carbonate of lithium, 5–50% by weight of at least one of iron oxides and nickel oxide, and less than 40% by weight of at least one of oxide and carbonate of alkaline earth metals (Japanese Laying-Open Patent Publication No. 5910/81).

Although the process exhibits high refining performance, it cannot, however, be said to be economical, because a slag containing a lithium compound, which is expensive, volatile and thus low in utilization efficiency, is used. On the other hand, in the dephosphorization reaction occurring in the refining of the plain carbon steel, it is believed that the dephosphorization product is calcium phosphate containing no fluorine, and in fact dephosphorization occurs even when the $CaF_2$ concentration is low. In the case of Cr pig iron, it is well known that dephosphorization hardly occurs with a CaO-iron oxide slag containing a very low concentration of $CaF_2$.

We studied dephosphorization of Cr pig iron in order to find an economical dephosphorization process or a dephosphorization slag and to elucidate the dephosphorization mechanism using slags of various compositions. We tried to identify the dephosphorization product with the aid of X-ray diffractometry, and we have reached the conclusion that in the dephosphorization product there exists $Ca_5F(PO_4)_3$ in addition to or instead of $Li_3PO_4$, which we previously believed to be the main dephosphorization product.

DISCLOSURE OF THE INVENTION

Thus according to this invention, there is provided a process for dephosphorization, desulfurization and denitrification of Cr pig iron comprising contacting the molten Cr pig iron with a slag comprising not less than 10% and less than 40% of CaO, not less than 5% and not more than 40% of iron oxides, more than 40% and not more than 80% of $CaF_2$, in which the amount of $SiO_2$ as an impurity is not more than 10% and the ratio $\%CaO/\%SiO_2$ is not less than 3. In this specification, the term "Cr pig iron" is defined as including Cr pig iron also containing Ni.

In the slag used in the process of this invention, CaO is essential as the dephosphorization reactant. As the dephosphorization product, existence of $Ca_5F(PO_4)_3$ has been confirmed and thus the reaction by which it is formed is considered to be:

$$3P+9/2CaO+\tfrac{1}{2}CaF_2+15/2FeO=Ca_5F(PO_4)_3+15/2Fe \quad (1)$$

If $CaCO_3$ is used instead of CaO, the same effect results. In order to carry out sufficient dephosphorization reaction and to maintain the basicity value (the ratio $\%CaO/\%SiO_2$) at not less than 3, at least 10% of CaO is required. But if the amount of CaO exceeds 40%, the melting temperature of the slag becomes too high, which is not desirable. If the basicity is less than 3, CaO is consumed by combining with $SiO_2$ and thus the reaction system becomes deficient in CaO content for the reaction (1).

As seen in the above reaction equation (1), like CaO, $CaF_2$ is an essential component for dephosphorization. $CaF_2$ has conventionally been used as a slag formation promotor. But this compound cannot be used in an unnecessarily large amount, since it attacks refractory materials. It is usually used in an amount of 10–40%. Prior to this invention, there has been no report of a high quality low silica fluorite being used in high concentration in the slag for oxidation refining as in this invention. As stated before, in the dephosphorization reaction in the refining of plain carbon steel, it is believed that the dephosphorization product is calcium phosphate that does not contain F, and therefore, a large amount of $CaF_2$ is not used. In our previous invention, we incorporated $CaF_2$ in the slag at such a high concentration as 30–80% without recognizing the reason therefor. Thereafter, however, we continued our study and we learned that not less than 40% of $CaF_2$ was necessary in order to successfully carry out the reaction (1). As has been described in the above, the purpose of the use of $CaF_2$ in the dephosphorization reactant in the invention of this application is quite different from that in the conventional slagmaking promoter. This is the reason why the amount of $CaF_2$ used in the process of this invention is remarkably higher than in the conventional steelmaking. The upper extreme of the $CaF_2$ amount is limited to 80% in consideration of the contents of the other ingredients.

As the reagent having the same performance as $CaF_2$ in this invention, $CaCl_2$ was referred to in the above-mentioned Japanese Laying-Open Patent Publication No. 77214/79. However, according to our experiments, $CaF_2$ is far more efficient in dephosphorization of Cr pig iron that $CaCl_2$, and the latter is strongly hygroscopic, which requires tightly closable containers for storage. Also $CaCl_2$ is highly corrosive and attacks iron structure materials if they are contaminated therewith. Further, $CaCl_2$ generates a large amount of fume at high temperatures and therefore it is not easy to handle and makes the operation in which it is used troublesome to conduct. In contrast, $CaF_2$ is chemically stable and generates far less fume. Thus $CaF_2$ is obviously superior to $CaCl_2$ as a dephosphorization slagmaking material in the steelmaking.

Iron oxides may be used in any form such as FeO, $Fe_2O_3$ or oxide scales. As seen in the equation (1), these materials act as the oxidizing agent and they are required in an amount of at least 5%. On the other hand, more than 40% of iron oxides impairs the fluidity of the slag. As the oxidizing agent, nickel oxide may also be used. In the process of this invention, $SiO_2$, $Al_2O_3$ and $Cr_2O_3$, which are regarded as incidental impurities, destabilize the dephosphorization products causing so-called rephosphorization. Therefore, the contents of these ingredients should be as low as possible. Especially, the $SiO_2$ content must be not more than 10%, and the ratio $\%CaO/\%SiO_2$ must be not less than 3.

The slag used in the process of this invention is easily contaminated with $SiO_2$ which comes from the residual slag of the preceding step. Of the materials constituting the slag used in the process of this invention, fluorite, the source of $CaF_2$, usually contains $SiO_2$ as an impurity. If the $SiO_2$ contamination from the preceding step is considered, it is necessary to use a fluorite having $SiO_2$ content of not more than about 8%. In order to reduce the $SiO_2$ content, skimming should be thoroughly carried out at the end of the preceding step, and a low $SiO_2$ content fluorite should be used.

The difference between the present invention and the dephosphorization process which we proposed previously (Japanese Laying-Open Patent Publication No. 5910/81) is that the slag used in the previous invention contains alkali metal compounds. Use of an alkali metal compound such as $Li_2CO_3$ is effective in that it combines with P to form a compound such as $Li_3PO_4$; and it combines with $SiO_2$ and $Cr_2O_3$ which are deleterious for dephosphorization so that their undesirable effects are reduced. Also alkali metal compounds lower the melting temperature of the slag and enhance the fluidity thereof, and thus increase the reaction rate. Although addition of an alkali metal compounds is effective as has been stated above, it is expensive as well known. On the other hand, even if the slag contains no alkali metal compounds, dephosphorization reaction takes place to some extent as has been explained above. In addition to dephosphorization; desulfurization and denitrification occur considerably, too. That is to say, the characteristics of the slag used in the present invention is that the cost thereof is low, although it is slightly inferior to the alkali-metal-compound-containing slag in dephosphorization and other refining reaction efficiency. Therefore this slag is effectively used when less strict refining conditions are permissible in the commercial scale operation.

For the purpose of dephosphorization, it is preferred to reduce the Si content of the molten iron to not more than 0.2% and to maintain the C content at least 4% beforehand. For the purpose of desulfurization and denitrification, the C content should preferably be maintained at least 4%. The proper amount of the slag for use in the process of this invention is 10–150 kg/ton metal. The temperature of the molten iron alloy to be treated is not critical, but 1400°–1650° C. is proper.

The refining effect is satisfactory at the $CaF_2$ concentration of more than 40%. However, lower concentration of $CaF_2$ is preferred as long as the refining effect is secured, because $CaF_2$ is high concentration tends to attack refractory materials. Also the Si concentration in molten iron alloy should preferably be as low as possible, since Si is oxidized in preference to P and thus hinders dephosphorization. Also the C concentration should preferably as high as possible, since C inhibits oxidation of Cr and thus enhances refining effect.

Therefore, a preferred slag comprises not less than 20% and less than 40% of CaO, not less than 15% and not more than 35% of iron oxides, more than 40% and not more than 60% of $CaF_2$ in which the content of $SiO_2$ as an impurity is not more than 10%, and the ratio $\%CaO/\%SiO_2$ is not less than 3. And a further preferred slag comprises not less than 25% and not more than 35% of CaO, not less than 20% and not more than 30% of iron oxides, and more than 40% and not more than 50% of $CaF_2$, in which the content of $SiO_2$ as an impurity is not more than 10% and the ratio $\%CaO/\%SiO_2$ is not less than 3%.

Also with respect to the composition of the molten iron alloy, more preferably, the Si content thereof is not more than 0.1% and the C content is not less than 4.5%, and further more preferably, the Si content is not more than 0.06% and the C content is not less than 5.0%.

According to this invention, under the above mentioned conditions, phosphorus can be removed by about 40%, sulfur by about 80% and nitrogen by about 70%.

DETAILED DESCRIPTION OF EMBODIMENTS

Now the invention is explained specifically by way of working examples.

Each (10) kg of 17% Cr-8% Ni iron alloy was melted in a graphite crucible and maintained at 1500° C. To this, 700 g of a slag each indicated in Table 1 was added and the melt was kept for 25 minutes under agitation with argon blowing. The samples of molten iron before and after the treatment were analysed. The results are shown in Table 1. The results of comparative examples which were carried out in the same way were summarized in Table 1, too.

Industrial Applicability

This invention brings about a new effective and economical process for dephosphorization, desulfurization and denitrification of Cr pig iron, and its contribution to the steelmaking technology is great.

TABLE 1

| | Ex. No. | Composition of Slag CaO | $CaF_2$ | FeO | $SiO_2$ | Time of Analysis | Composition of Iron Alloy (%) C | Si | P | S | N |
|---|---|---|---|---|---|---|---|---|---|---|---|
| Examples of the invention | 1 | 10 | 80 | 10 | 0 | Before tr. | 5.90 | <0.05 | 0.031 | 0.030 | 0.020 |
| | | | | | | After tr. | 5.94 | <0.05 | 0.019 | 0.006 | 0.007 |
| | 2 | 38 | 42 | 20 | 0 | Before tr. | 6.01 | <0.05 | 0.029 | 0.026 | 0.022 |
| | | | | | | After tr. | 6.02 | <0.05 | 0.017 | 0.005 | 0.007 |
| | 3 | 10 | 50 | 40 | 0 | Before tr. | 5.88 | <0.05 | 0.032 | 0.029 | 0.019 |
| | | | | | | After tr. | 5.86 | <0.05 | 0.019 | 0.006 | 0.007 |
| | 4 | 20 | 50 | 25 | 5 | Before tr. | 5.92 | <0.05 | 0.028 | 0.028 | 0.018 |
| | | | | | | After tr. | 5.93 | <0.05 | 0.017 | 0.006 | 0.006 |
| | 5 | 30 | 45 | 25 | 0 | Before tr. | 6.05 | <0.05 | 0.029 | 0.031 | 0.020 |

TABLE 1-continued

| | Ex. No. | Composition of Slag CaO | $CaF_2$ | FeO | $SiO_2$ | Time of Analysis | Composition of Iron Alloy (%) C | Si | P | S | N |
|---|---|---|---|---|---|---|---|---|---|---|---|
| | | | | | | After tr. | 6.03 | <0.05 | 0.017 | 0.006 | 0.005 |
| Comparative Examples | 1 | 45 | 35 | 20 | 0 | Before tr. | 5.95 | <0.05 | 0.029 | 0.026 | 0.019 |
| | | | | | | After tr. | 5.93 | <0.05 | 0.027 | 0.013 | 0.010 |
| | 2 | 38 | 45 | 5 | 12 | Before tr. | 5.96 | <0.05 | 0.028 | 0.028 | 0.019 |
| | | | | | | After tr. | 5.98 | <0.05 | 0.025 | 0.013 | 0.011 |
| | 3 | 17 | 50 | 25 | 8 | Before tr. | 5.83 | <0.05 | 0.027 | 0.029 | 0.018 |
| | | | | | | After tr. | 5.85 | <0.05 | 0.027 | 0.020 | 0.015 |

We claim:

1. A process for dephosphorization, desulfurization and denitrification of chromium-containing pig iron comprising contacting the melt of said iron with a slag comprising not less than 10% and less than 40% of CaO, not less than 5% and not more than 40% of iron oxides and more than 40% and not more than 80% of $CaF_2$ in which the contact of $SiO_2$ as an impurity is not more than 10% and the ratio $\%CaO/\%SiO_2$ is not less than 3.

2. The process for dephosphorization, desulfurization and denitrification of chromium-containing pig iron as claimed in claim 1, wherein the slag comprises not less than 20% and less than 40% of CaO, not less than 15% and not more than 35% of iron oxides and more than 40% and not more than 60% of $CaF_2$.

3. The process for dephosphorization, desulfurization and denitrification of chromium-containing pig iron as claimed in claim 2, wherein the slag comprises not less than 25% and not more than 35% of CaO, not less than 20% and not more than 30% of iron oxides and more than 40% and not more than 50% of $CaF_2$.

4. The process for dephosphorization, desulfurization and denitrification of chromium-containing pig iron as claimed in any one of claim 1 to 3, wherein iron oxides in the slag are partly replaced with nickel oxide.

5. The process for dephosphorization, desulfurization and denitrification of chromium-containing pig iron as claimed in any one of claim 1 to 3, wherein the Si content in the molten iron is reduced to 0.2% or less prior to the contact with the slag.

6. The process for dephosphorization, desulfurization and denitrification of chromium-containing pig iron as claimed in claim 1 to 3, wherein the Si content is reduced to 0.1% or less.

7. The process for dephosphorization, desulfurization and denitrification of chromium-containing pig iron as claimed in any one of claim 1 to 3, wherein the carbon content of the molten iron is maintained at not less than 4% prior to the contact with the slag.

8. The process for dephosphorization, desulfurization and denitrification of chromium-containing pig iron as claimed in claim 1 to 3, wherein the carbon content of the molten iron is maintained at not less than 4.5% prior to the contact with the slag.

9. The process for dephosphorization, desulfurization and denitrification of chromium-containing pig iron as claimed in claim 1 to 3, wherein the carbon content of the molten iron is maintained at not less than 5.0%.

10. The process for dephosphorization, desulfurization and denitrification of chromium-containing pig iron as claimed in any one of claim 1 to 3, wherein the chromium-containing pig iron also contains nickel.

11. The process for dephosphorization, desulfurization and denitrification of chromium-containing pig iron as claimed in any one of claim 1 to 3, wherein CaO is partly or wholly replaced with a corresponding amount of $CaCO_3$.

* * * * *